US005320120A

United States Patent [19]

Hoffman et al.

[11] Patent Number: 5,320,120

[45] Date of Patent: Jun. 14, 1994

[54] DISHWASHER WITH DUAL PUMPS

[75] Inventors: Roger L. Hoffman; Joseph D. Tobbe; Gregory O. Miller, all of Louisville, Ky.

[73] Assignee: General Electric Company, Louisville, Ky.

[21] Appl. No.: 77,274

[22] Filed: Jun. 17, 1993

[51] Int. Cl.[5] ..... A47L 15/22; A47L 15/42

[52] U.S. Cl. ..... 134/104.1; 134/111

[58] Field of Search ..... 134/104.1, 104.4, 111

[56] References Cited

U.S. PATENT DOCUMENTS

| | | | |
|---|---|---|---|
| 1,995,635 | 3/1935 | Clark | 134/57 D |
| 2,700,978 | 2/1955 | Pietsch | 134/186 |
| 2,935,207 | 5/1960 | Miller | 134/186 X |
| 3,183,120 | 5/1965 | Mori | 134/7 |
| 3,807,419 | 4/1974 | Cushing et al. | 134/104.1 |
| 3,810,480 | 5/1974 | Smith et al. | 134/104.1 |
| 4,754,770 | 7/1988 | Fornasari | 134/57 D |
| 4,848,382 | 7/1989 | Bertsch et al. | 134/111 |
| 4,969,479 | 11/1990 | Lagerstrand | 134/111 X |
| 4,972,861 | 11/1990 | Milocco et al. | 134/111 X |
| 5,097,855 | 3/1992 | Martinsson et al. | 134/111 X |

FOREIGN PATENT DOCUMENTS

| | | | |
|---|---|---|---|
| 0198496 | 10/1986 | European Pat. Off. | 134/111 |
| 2449814 | 4/1976 | Fed. Rep. of Germany | 134/104.1 |

*Primary Examiner*—Philip R. Coe

*Attorney, Agent, or Firm*—H. Neil Houser

[57] ABSTRACT

A dishwashing machine includes a wash chamber and spray distribution mechanism to spray fluid over articles in the chamber. A recirculation sump at the bottom of the chamber receives fluid from the chamber and a first pump, driven by a relatively large motor, draws fluid from the sump and discharges it to the spray mechanism. A filter is positioned to remove soil particles from the recirculated fluid and a collection chamber collects filtered soil particles. The collection chamber is connected to a drain through a first one way valve. A drain pump, driven by a relatively small motor, is connected between the lower portion of the recirculation sump and the collection chamber. Another one way valve permits flow from the recirculation sump to the collection chamber while preventing reverse flow. Operation of the drain pump substantially completely evacuates fluid from the wash chamber and the sump through the collection chamber to the drain and concurrently discharges soil particles from the collection chamber to the drain.

8 Claims, 1 Drawing Sheet

DISHWASHER WITH DUAL PUMPS

BACKGROUND OF THE INVENTION

This invention relates to dishwashing machines and, more particularly to such machines incorporating a first pump and drive motor to recirculate fluid for washing articles in the machine and a separate pump and drive motor arranged to essentially completely discharge the wash fluid to drain and concurrently discharge accumulated soil particles to drain.

Typical domestic dishwashers in use today draw fluid from a sump at the bottom of the wash chamber and spray the fluid through various mechanisms in the wash chamber to wash soil from articles located in the chamber. Many such dishwashing machines include filter mechanisms to remove soil particles from the recirculated fluid. One such filter arrangement is disclosed in U.S. Pat. No. 3,807,419, which is incorporated herein by reference.

Normally, at the end of a wash or rinse cycle, much of the fluid in the washing machine is exhausted to a drain. However, prior art machines have not been of optimal design and operation as regards the drain operation. In many machines the arrangement of the sump, the recirculation pump and the drain pump is such that a significant residue of fluid remains in the sump and recirculation pump when the drain operation is complete. U.S. Pat. No. 3,810,480 discloses a dishwashing machine which uses a recirculation pump and a drain pump driven by a common motor to provide substantially complete draining of the sump. However, as the recirculation pump needs significantly more power than the drain pump, such an arrangement involves less than optimum usage of electric power, particularly during drain operations. Furthermore it depends upon operation of the drain pump, in its reverse direction, to prevent any fluid from being drawn back into the machine from the drain.

Prior art machines which filter soil particles from the recirculated fluid, normally discharge the accumulated soil particles through the drain pump. This is not the most effective arrangement as it requires that the drain pump cavity and blades be large enough to pass the largest soil particles. In addition, such operations often leave some soil particles in areas of the machine, like the sump for example, that can adversely effect the next operation of the machine.

It is an object of the present invention to provide a dishwashing apparatus which provides for substantially complete evacuation of the wash chamber and sump in an energy efficient manner and with a mechanism which effectively uses the available space.

It is another object of this invention to provide such an improved apparatus in which accumulated soil particles are prevented from returning to the recirculated fluid in a subsequent operation.

It is yet another object of this invention to provide such an improved dishwashing apparatus in which fluid being drained from the machine carries accumulated soil particles to drain without the particles moving through the drain pump mechanism.

SUMMARY OF THE INVENTION

The above and other objects are provided in a dishwashing apparatus which has a wash chamber to receive wash fluid and articles to be washed by the fluid. A spray mechanism is provided to spray recirculated fluid into the chamber for washing the articles. A recirculation sump is located at the bottom of the chamber to receive fluid. A recirculation pump, driven by a relatively large motor, has its inlet connected to the recirculation sump and its outlet connected to the spray distribution mechanism to withdraw fluid from the sump and supply it to the spray distribution mechanism. A filter is positioned to remove soil particles from the recirculated fluid and a soil collection chamber is connected to the filter to collect particles removed from the fluid. The soil collection chamber is connected to a drain through a first valve which permits fluid to flow from the collection chamber to the drain while preventing reverse fluid flow. A drain pump, driven by a relatively small motor, has its inlet connected to the recirculation sump and its outlet connected to the soil collection chamber and is constructed and arranged to substantially empty the recirculation sump. A second valve connected in series with the drain pump between the recirculation sump and the soil collection chamber permits fluid to flow from the recirculation sump to the soil collection chamber while preventing reverse fluid flow. Operation of the drain pump substantially completely evacuates fluid from the recirculation sump to the drain through the collection chamber and concurrently discharges accumulated soil particles to the drain. A third valve permits soil particles to move from the filter to the soil collection chamber during fluid recirculation operation and prevents reverse movement of particles during drain operation. In a preferred embodiment the recirculation sump, recirculation pump and drain pump are positioned below the wash chamber and each pump and its motor has a horizontal axis of operation.

DETAILED DESCRIPTION OF PREFERRED EMBODIMENT

Figure 1:
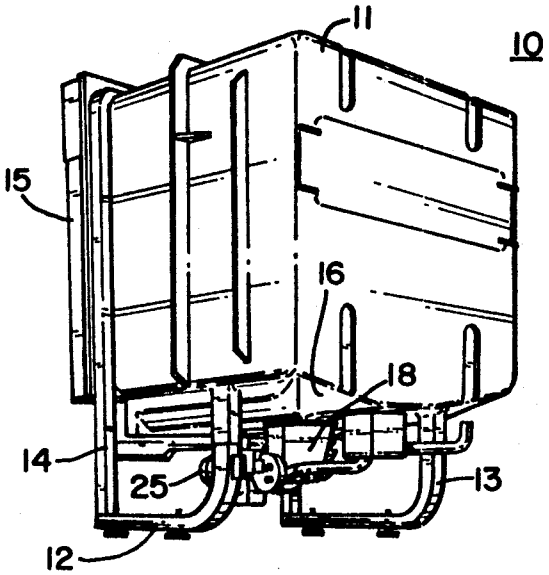
FIG. 1 is a somewhat simplified perspective view of an under-the-counter type dishwashing apparatus, with the sound insulation removed for purposes of illustration.

Referring now to the drawings, and particularly to FIG. 1, there is shown a dishwashing machine or apparatus 10 including a box like housing 11 which conveniently may be formed from some suitable plastic material such as polypropylene. The housing 11 is supported on braces 12 and 13 joined by a collar 14 which supports an open front of the housing (not shown). A door 15 is pivotedly mounted to selectively close the housing opening. The housing side walls (including the rear wall opposite the front opening and door 15) are generally planar and are vertically disposed. The bottom wall 16 is generally horizontal but slopes so that its lowest portion occurs at its center.

Figure 2:
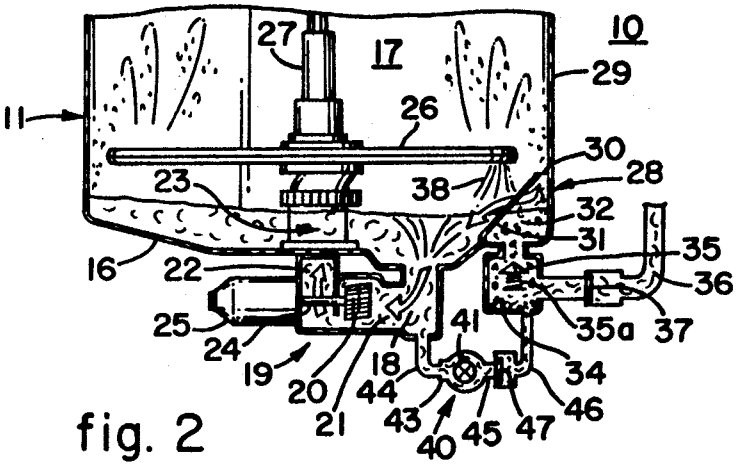
FIG. 2 is a simplified, schematic, partial side elevation view of the machine of FIG. 1, illustrating a recirculation operation.

Referring now to FIG. 2, the housing 11 and door 15 define a wash chamber 17 to receive items to be washed, such as dishes, glasses, silver ware and utensils. Normally such items are supported on suitable moveable racks, which form no part of the present invention and have been omitted for the sake of simplicity. Fluid is supplied to the chamber 17 and is sprayed on the articles to wash and rinse them. To that end, a recirculation sump 18 is positioned below and communicates with the lower portion of the chamber 17. A relatively large recirculation pump 19 includes an impeller 20 having its inlet 21 connected to sump 18 and its outlet 22 connected to a spray distribution mechanism 23. The impeller 20 is mounted for rotation with a drive shaft 24 that, in turn, is connected to the rotor (not shown) of a motor 25. The impeller and motor have a horizontal axis of rotation which means that the long dimension of the motor pump assembly runs across the bottom of the housing rather than perpendicular to the housing, This minimizes the space need for the recirculation mechanism and helps maximize the capacity of the wash chamber possible under a normal kitchen countertop.

The illustrative spray distribution mechanism includes a rotatable lower wash arm 26 and a rotatable tower 27. When the motor 25 rotates impeller 20, it withdraws fluid from sump 18 and discharges it through the wash arm 26 and tower 27. Typically the arm and tower rotate and discharge the fluid into the chamber 17 to wash items supported therein on the racks. It will be understood that the arm 26 and tower 27 are illustrative only and other spray devices and mechanisms may be employed. For example, an additional spray device often is positioned at the top of chamber 17 to spray fluid down upon the articles to be washed. The fluid is continuously recirculated, that is it is withdrawn from sump 18, is discharged from the spray mechanism 23 and returns to the sump. Some of the recirculated fluid falls directly from the articles and racks to the bottom of chamber 17, while some of the fluid runs down the side walls of the housing. A filter mechanism 28 is positioned along the junction of the bottom wall 16 and a side wall 29, which conveniently may be the rear wall opposite door 15. Conveniently the filter 28 includes an open top 30 adjacent the side wall 29 and a filter element 31 facing the wash chamber 17 and slanted slightly from the vertical. Conveniently the filter element may be a perforated plate or a screen member. The bottom of the filter 28 is connected in fluid flow with a collection chamber 34 and a valve 35 is positioned between the filter mechanism and the collection chamber. Conveniently the valve is biased by a spring **35*a* to its open position shown in FIG. 2, in which valve 35 permits soil particles to settle or drop from the filter chamber 32 into the soil collection chamber 34. As will be described in more detail hereinafter, flow of fluid through soil collection chamber to drain overcomes the bias of spring 35*a* and valve 35 closes so soil particles are not returned from soil collection chamber 34 to filter chamber 32 or wash chamber 17** during drain operations.

Recirculated fluid flowing down the wall 29 enters the essentially open top 30 of the filter mechanism, carrying with it soil particles which have been washed from the items in the wash chamber. Once in the filter chamber 32 behind the filter element 31, the large particles tend to settle downwardly and enter the soil collection chamber 34. Some of the smaller particles follow a similar course into the collection chamber. However other of the particles, particularly smaller particles, tend to be forced against the filter element 31 by the fluid as it flows from filter chamber 32 into main wash chamber 17. The filter element 31 screens these particles out of the fluid and they tend to build up on the filter chamber side of the element 31. At least one end of the arm 26 is provided with a downwardly facing opening which emits a spray of fluid downwardly as indicated at 38. As the arm rotates, from time to time the spray 38 impinges on the wash chamber side of filter element 31 and washes accumulated soil particles off the other side of the element. These particles then tend to settle into the soil collection chamber 34.

The accumulated soil particles are then held within the soil collection chamber 34 apart from the wash chamber 17. The soil collection chamber 34 is connected to the normal household drain, represented by conduit 36, through a one-way valve 37. Typically the valve 37 is spring biased and opens under high pressure to permit fluid to flow from soil collection chamber 34 to drain conduit 36. Alternatively it may be operated by some mechanism such as a solenoid to permit such a fluid flow. In any event the valve 37 effectively prevents reverse fluid flow from the conduit 36 into the chamber 34.

Figure 3:
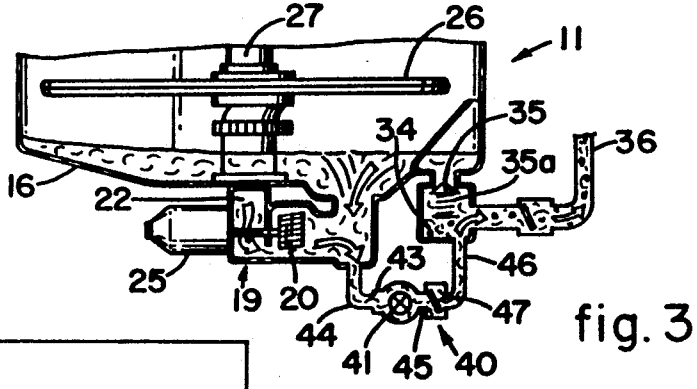
FIG. 3 is a partial side elevation view similar to FIG. 2 but illustrating a drain operation.
Figure 4:
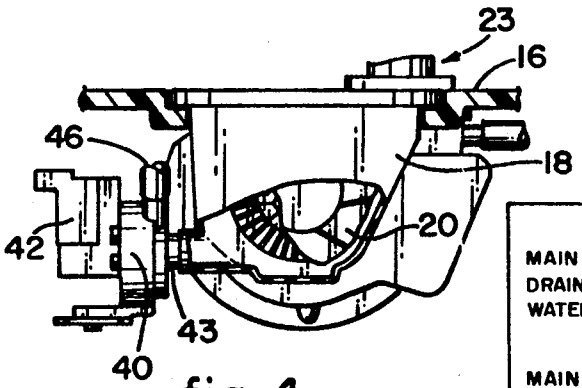
FIG. 4 is a fragmentary elevation view, partly broken away, illustrating details of the recirculation sump, recirculation pump and drain pump.

Referring now more particularly to FIGS. 3 and 4, a drain pump 40 includes an impeller 41 driven by a relatively small electric motor 42. The impeller 41 and motor 42 conveniently may have a horizontal axis of rotation permitting them to be mounted in available space without unduly adding to the height of the dishwashing apparatus. The inlet 43 of pump 40 has a suitable fluid connection with the lower most portion of recirculation sump 18 as by a conduit 44 and the outlet 45 of the pump 40 is connected to soil collection chamber 34 by a conduit 46. A one-way valve 47 is positioned in the fluid path between the recirculation sump 18 and soil collection chamber 34 in series with drain pump 40 and functions in a manner similar to valve 37. That is, it permits fluid to flow from recirculation sump 18 to soil collection chamber 34 when pump 40 is operated while always preventing reverse fluid flow from chamber 34 to sump 18. In the illustrative embodiment valve 47 is positioned at the outlet 45 of pump 40. With that configuration, some of the minimum amount of fluid remaining in the drain pump 40 at the end of a drain operation may migrate back to the recirculation sump 18. If desired, the valve 47 may be positioned between the recirculation sump 18 and the drain pump 40, as at the inlet 43 of the pump. With that arrangement no fluid will be able to migrate back to the recirculation sump 18.

When the motor 42 is energized, it causes impeller 41 to rotate and draw fluid from the sump 18 and discharge it through collection chamber 34 to the drain conduit 36. The pressure of this fluid flow overcomes the bias effect of spring **35*a* and valve 35 closes, preventing flow of fluid from soil collection chamber 34 back into filter chamber 32. As the fluid in sump 18 is withdrawn, any fluid standing in wash chamber 17 will flow into sump 18 and then be exhausted from the apparatus 10. Also, the spray distribution mechanism is open to reverse flow of fluid back to the sump 18 once the recirculation pump 19** is turned off. Thus the drain pump will discharge any fluid remaining in the spray mechanism at the conclusion of the recirculation operation.

The flow of fluid through the collection chamber 34 from pump 40 effectively discharges soil particles from the soil collection chamber to the drain conduit. Since the connection between the recirculation sump 18 and drain pump 40 is at the lower most portion of the sump and the sump is below the bottom of wash chamber 17, the drain pump effectively discharges to drain essentially all the fluid in the wash chamber, including the spray mechanism 23 and filter chamber 32.

The soil collection chamber 34 is between drain pump 40 and drain conduit 36. Thus the drain pump does not have to pass the soil particles filtered from the fluid and can be made more compact. Also less power is required to discharge the fluid to drain than is required to recirculate a sufficient volume of fluid at sufficient pressure to clean articles typically washed in such dishwashing machines. For example, in a type domestic dishwashing machine effective recirculation may require between about 300 and about 500 watts of power while draining requires only between about 50 and about 100 watts of power. By using separate pumps and motors the drain motor can be significantly smaller than the recirculation motor, thereby saving energy.

Figure 5:
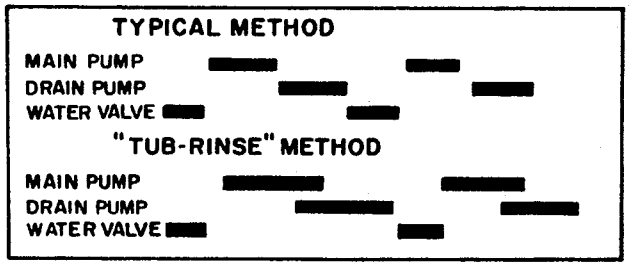
FIG. 5 is a simplified timing chart illustrating two modes of operation of the apparatus of FIGS. 1–4.

FIG. 5 shows two exemplification cycles of operation which illustrate another advantage of separate pump motors. In each portion of FIG. 5 a line means that the corresponding component is energized and a blank space indicates that the component is off. The top chart, labeled "TYPICAL METHOD" illustrates a simplified sequence of operation of a known dishwasher. First water is admitted into the wash chamber, and detergent is added either manually or by some known mechanism. Once the proper amount of water is in the machine, the water valve is closed and recirculation pump 19 is operated for a predetermined time to wash the articles in chamber 17. At the end of the wash period of operation the recirculation pump 19 is deactivated and drain pump 40 is operated for a predetermined period to exhaust the spent fluid (wash water) from the machine. The process is repeated to rinse the articles. It will be understood that other steps such as, for example, a prewash step and additional rinse steps may be included.

This type of operation can be accomplished with either separate motors for each of the pumps, such as disclosed herein, or with a single motor driving both pumps. In single motor machines rotation of the motor in one direction operates the recirculation pump and rotation of the motor in the other direction operates the drain pump. In another single motor system a solenoid operated valve is used to change the fluid flow from the pump between recirculation and drain. With this type of machine operation use of a separate relatively large recirculation motor and a relatively small drain motor saves electric energy.

The lower chart, labeled "TUB RINSE METHOD" takes advantage of the fact that both pumps can be operated simultaneously to wash down the inside of the housing as the drain operation begins. To that end the initial portion of drain pump operation is concurrent with the terminal portion of the prior recirculation operation. This will provide a wash or rinse action on the housing walls. In that regard it will be understood that, as the drain pump discharges fluid from chamber 17 and sump 18, the water supply for recirculation pump 19 shrinks and pump 19 will cavitate. Thus the streams of fluid from the spray mechanism will become less powerful and, instead of projecting generally upward against the articles to be washed, they will project generally outward and tend to impinge directly upon the walls of housing 11. Once pump 19 ceases to be effective its operation is stopped and drain pump continues to operate until essentially all the fluid is discharged from the apparatus 11. A TUB RINSE METHOD of operation can be performed only with separate recirculation and drain motors as a single motor will not concurrently recirculate and drain fluid.

What is claimed is:

1. A dishwashing apparatus, comprising:

a wash chamber for receiving washing fluid and articles to be washed by the fluid;

fluid recirculation means comprising spray means for spraying fluid into said wash chamber to remove soil particles from articles therein, a recirculation sump for receiving fluid from said wash chamber, a recirculation pump having its inlet connected to said recirculation sump and its outlet connected to said spray means and a relatively large motor drivingly connected to said recirculation pump for causing said pump to withdraw fluid from said recirculation sump and supply it to said spray means;

filter means for removing soil particles from the recirculated fluid;

a collection chamber connected to said filter means for collecting soil particles removed from the recirculated fluid;

first valve means for connecting said collection chamber to a drain and effective to permit flow of fluid from said collection chamber to the drain while preventing reverse fluid flow;

drain means comprising a relatively small motor drivingly connected to a drain pump, said drain pump having an inlet connected to said recirculation sump and an outlet connected to said collection chamber and being positioned to substantially completely empty said recirculation sump;

and second valve means connected in series with said drain pump between said recirculation sump and said collection chamber and effective to permit fluid flow from said recirculation sump to said collection chamber while preventing reverse fluid flow; whereby operation of said drain pump substantially completely evacuates the fluid from said wash chamber and recirculation sump to the drain through said collection chamber and concurrently discharges accumulated soil particles from said collection chamber to the drain.

2. A dishwashing apparatus as set forth in cliam 1, further comprising: third valve means connected between said filter means and said collection chamber and effective to permit fluid and soil particles to pass from said filter means to said collection chamber during operation of said recirculation pump and to prevent fluid and soil particles from passing from said collection chamber to said filter means during operation of said drain pump.

3. A dishwashing apparatus as set forth in claim 1, wherein: said spray means and said recirculation pump are configured and arranged such that fluid in said spray means at the conclusion of a period of recirculation pump operation will flow back to said recirculation sump.

4. A dishwashing apparatus as set forth in claim 1, wherein: said recirculation sump, said recirculation pump and said drain pump are positioned below said wash chamber; said first motor and said recirculation pump have a horizontal axis of operation; and said second motor and drain pump have a horizontal axis of operation.

5. A dishwashing machine as set forth in claim 1, wherein: said second valve means is connected between said drain pump and said collection chamber.

6. A dishwashing machine as set forth in claim 1, wherein: said second valve means is connected between said drain pump and said recirculation sump.

7. A dishwashing apparatus as set forth in claim 1, wherein: said second motor begins operation subsequent to a period of operation of said first motor.

8. A dishwashing apparatus as set forth in claim 1, wherein: the initial portion of a period of operation of said second motor is concurrent with the terminal portion of a period of operation of said first motor.

* * * * *